US011105188B2

(12) United States Patent
Camp et al.

(10) Patent No.: US 11,105,188 B2
(45) Date of Patent: Aug. 31, 2021

(54) PERFORATION TOOL AND METHODS OF USE

(71) Applicant: Halliburton Energy Services, Inc., Houston, TX (US)

(72) Inventors: Joshua Lane Camp, Friendswood, TX (US); Mikko Jaaskelaninen, Katy, TX (US); Eric James Davis, El Cerrito, CA (US); Henry Clifford Bland, Calgary, CA (US)

(73) Assignee: Halliburton Energy Services, Inc., Houston, TX (US)

( * ) Notice: Subject to any disclaimer, the term of this patent is extended or adjusted under 35 U.S.C. 154(b) by 66 days.

(21) Appl. No.: 16/556,588

(22) Filed: Aug. 30, 2019

(65) Prior Publication Data

US 2021/0062623 A1 Mar. 4, 2021

(51) Int. Cl.

| | |
|---|---|
| ***E21B 33/13*** | (2006.01) |
| ***E21B 43/116*** | (2006.01) |
| *E21B 47/007* | (2012.01) |

(52) U.S. Cl.

CPC ..... *E21B 43/116* (2013.01); *E21B 33/13* (2013.01); *E21B 47/007* (2020.05)

(58) Field of Classification Search

CPC ..... E21B 43/11; E21B 43/116; E21B 43/261; E21B 43/263; E21B 33/13; E21B 47/007; E21B 43/14; C09K 8/805

See application file for complete search history.

(56) References Cited

U.S. PATENT DOCUMENTS

| | | | | |
|---|---|---|---|---|
| 8,936,085 | B2 | 1/2015 | Boney et al. | |
| 9,752,423 | B2 * | 9/2017 | Lynk | E21B 33/134 |
| 2011/0266001 | A1 | 11/2011 | Dykstra et al. | |
| 2012/0043092 | A1 * | 2/2012 | Arizmendi, Jr. | E21B 43/14 166/369 |
| 2013/0341014 | A1 * | 12/2013 | Trummer | E21B 33/02 166/252.6 |
| 2016/0040520 | A1 | 2/2016 | Tolman | |
| 2019/0218901 | A1 * | 7/2019 | Groover | E21B 44/00 |
| 2020/0378231 | A1 * | 12/2020 | Coats | E21B 43/267 |

* cited by examiner

*Primary Examiner* — Yong-Suk (Philip) Ro
(74) *Attorney, Agent, or Firm* — Chamberlain Hrdlicka

(57) ABSTRACT

A perforation tool for perforating casing in a borehole. The perforation tool may include a body, charges spaced along an axial length of the body, and a first compartment positioned along the axial length of the body. The compartment may be filled with a diverter material and operable to selectively release the diverter material.

12 Claims, 7 Drawing Sheets

PERFORATION TOOL AND METHODS OF USE

BACKGROUND

This section is intended to provide relevant background information to facilitate a better understanding of the various aspects of the described embodiments. Accordingly, it should be understood that these statements are to be read in this light and not as admissions of prior art.

Boreholes are drilled into a formation to extract production fluid, such as hydrocarbons, from the formation. To secure the borehole, casing is set within the borehole and cement is pumped into an annular area between a wall of the borehole and the casing. After the casing has been set, a downhole tool, such as a perforation tool, is conveyed into the borehole to perforate the casing. The perforation tool includes a number of charge clusters arranged together in a cluster.

After the perforation tool reaches a desired zone within the borehole, the charges are detonated, thereby forming perforation tunnels through the casing and into the formation. Fluid is then pumped into the formation through the perforations in the casing to create a fracture cluster in the formation and also to potentially perform treatment operations on the fracture cluster.

Often, multiple fracture clusters spaced along the wellbore are created in the formation to increase the production of hydrocarbons from the formation. However, the process of creating and treating multiple fracture clusters can be time consuming, as it often requires a tool to traverse a perforated borehole multiple times to set frac plugs that allow independent creation and treatment of the fracture clusters. Alternatively, the multiple fracture clusters can be treated at the same time, but with reduced control over the growth of the individual fracture clusters, which can result in an ineffective treatment of some fracture clusters. The reduction in control also increases the risk of damaging the formation.

BRIEF DESCRIPTION OF THE DRAWINGS

Embodiments of the self-disabling detonator are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a perforation tool and a method of perforating a casing of a borehole. Additionally, the perforation tool releases diverter material into the borehole, allowing for the creation and treatment of multiple fractures in a formation without moving the perforation tool.

A main borehole may in some instances be formed in a substantially vertical orientation relative to a surface of the well, and a lateral borehole may in some instances be formed in a substantially horizontal orientation relative to the surface of the well. However, reference herein to either the main borehole or the lateral borehole is not meant to imply any particular orientation, and the orientation of each of these boreholes may include portions that are vertical, non-vertical, horizontal or non-horizontal. Further, the term "uphole" refers a direction that is towards the surface of the well, while the term "downhole" refers a direction that is away from the surface of the well.

Figure 1:
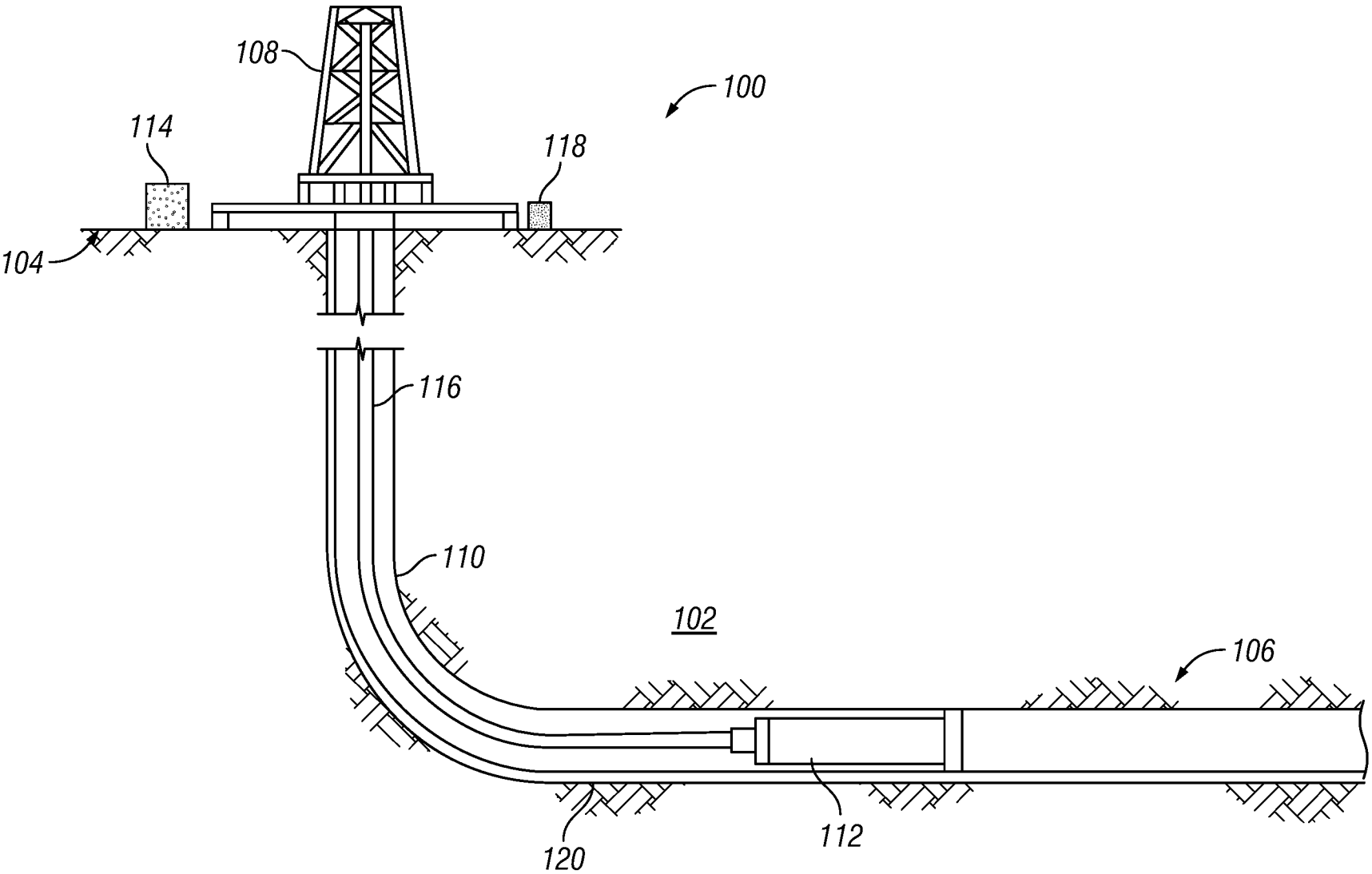
FIG. 1 is a cross-sectional diagram of a fracturing system, according to one or more embodiments.

FIG. 1 is a cross-sectional diagram of a fracturing system 100 for fracturing a downhole formation 102 in communication with the surface 104 through a borehole 106, according to one or more embodiments disclosed. As illustrated, the fracturing system 100 may include a service rig 108 that is positioned on the Earth's surface 104 and extends over and around a borehole 106 that penetrates a subterranean formation 102. The service rig 108 may be a drilling rig, a completion rig, a workover rig, or any other type of rig used in oil and gas operations.

In some embodiments, the service rig 108 may be replaced with a standard surface wellhead completion or installation (not shown). Further, while the fracturing system 100 is depicted as a land-based operation, it will be appreciated that the principles of the present disclosure could equally be applied in any sea-based or sub-sea application where the service rig 108 may be on a floating platform or sub-sea wellhead installation.

The borehole 106 is drilled into the subterranean formation 102 using any suitable drilling technique and extends in a substantially vertical direction away from the Earth's surface 104 over a vertical borehole portion. At some point in the borehole 106, the vertical borehole portion may deviate from vertical and transition into a deviated borehole portion that may be, for example, substantially horizontal, although such deviation is not required. In other embodiments, the borehole 106 may be any combination of vertical, horizontal, or deviated. Casing 110 is then cemented within the borehole 106. The casing 110 may extend through the entire length of the borehole 106 or through only a portion of the borehole 106. As used herein, the term "casing" refers not only to casing as generally known in the art, but also to borehole liner, which comprises tubular sections coupled end to end but not extending to a surface location.

The fracturing system includes a perforation tool 112, such as the perforation tool described in more detail below. The perforation tool 112 is conveyed into the borehole 106 on a conveyance 116 that extends from the service rig 108. The conveyance 116 that delivers the borehole isolation device 112 downhole may be, but is not limited to, a wireline, a slickline, an electric line, coiled tubing, drill pipe, production tubing, a tool string, or the like. The perforation tool 112 is conveyed downhole to a target location (not shown) within the borehole 106. As discussed below, the charge clusters installed on the perforation tool 112 are then detonated to perforate the casing 110.

A pump 114 pumps hydraulic fluid downhole from the service rig 108 at the surface 104 to apply a fluid pressure to the perforation tool 112 to move or help move the perforation tool 112 to the target location. The conveyance 116 controls the movement of the perforation tool 112 as it traverses the borehole 106 by preventing the perforation tool 112 from traveling beyond the target location. When the perforation tool 112 reaches the target location, a control system 118 is used to send a control signal through the conveyance 116 to detonate the charge clusters via a detonator of the perforation tool 114.

Once a charge cluster has been detonated to perforate the casing 114, the pump 114 pumps fracturing fluid downhole at a sufficient pressure to create fractures in the formation 102 surrounding the perforations. As the fractures are being created, sensors, e.g., a fiber optic sensor 120, microdeformation sensors, and/or microseismic sensors, are used to determine the geometry of the fracture.

It will be appreciated by those skilled in the art that even though FIG. 1 depicts the perforation tool 112 as arranged and operating in the horizontal portion 112 of the borehole 106, the embodiments described herein are equally applicable for use in portions of the borehole 106 that are vertical, deviated, or otherwise slanted.

Figure 2:
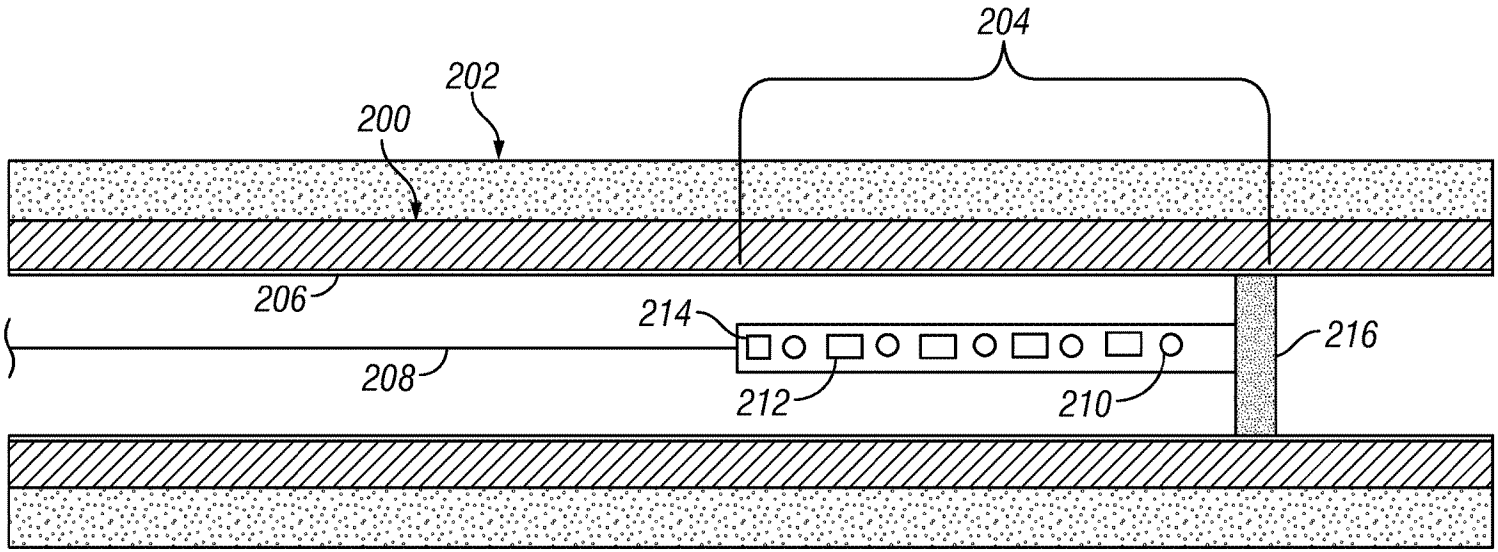
FIG. 2 is a cross-sectional diagram of a borehole with a perforation tool, according to one or more embodiments.

Referring now to FIG. 2, a cross-sectional diagram of a borehole 200 is shown in a formation 202 with a perforation tool 204, according to one or more embodiments. As shown in FIG. 2, the perforation tool 204 is positioned within a casing 206 that has been cemented into the borehole 200. A wireline 208 is used to control the position of the perforation tool 204, as well as provide a communication path for control signals to the perforation tool 204 from the control system 118 shown in FIG. 1 to perform various operations, as described below. As previously discussed, the perforation tool 204 may also be positioned within the casing 206 via a slickline, an electric line, coiled tubing, drill pipe, production tubing, a tool string, or the like, which would also provide communication paths for control signals to the perforation tool 204 from the control system 118 shown in FIG. 1.

The perforation tool includes charges or charge clusters 210 that are axially spaced apart from each other along the axial length of the perforation tool 210. In some embodiments, the charges or the charge clusters 210 are spaced apart by 25 feet to 100 feet. In other embodiments, the charges or charge clusters 210 may be spaced apart by less than 25 feet or more than 100 feet. The perforation tool 204 also includes one or more compartments 212 containing diverter material. As shown in FIG. 2, the compartments 212 may be placed between charges or charge clusters 210. The compartments 212 may also be placed at the uphole end of the perforation tool 204. The compartments 212 contain diverter material that may be mechanical diverter material, such as balls or pods. Alternatively, the diverter material may include chemical diverter material, such as polylactic acid (PLA), or a combination of mechanical and chemical diverter material.

In at least one embodiment, the compartments 212 are opened using charges (not shown) that are detonated via a detonator (not shown) upon receiving a corresponding signal from the control system 118. In other embodiments, the control system 118 sends a signal downhole to actuate a corresponding electromechanical actuator (not shown) coupled to a compartment 212. Additionally, the control system 118 monitors the compartments 212 to determine how many compartments 212 still remain closed.

The perforation tool 204 also includes a pressure sensor 214 positioned to measure pressure within the borehole 200 and a plug 216 to seal the casing 206 downhole of the perforation tool 204. The plug 216 is positioned on the downhole side of the perforation tool 204 and is expanded via charges or mechanical compression to create a seal against the casing 206. In other embodiments, the pressure sensor 214, plug 216, or both may be omitted. Embodiments that omit the plug 216 may include a separate plug assembly (not shown) that seals the casing 206 downhole of the perforation tool 204 or the perforation tool 204 may seat into an assembly (not shown) installed within the casing 206 to seal the casing 206 downhole of the perforation tool 204.

Figure 3:
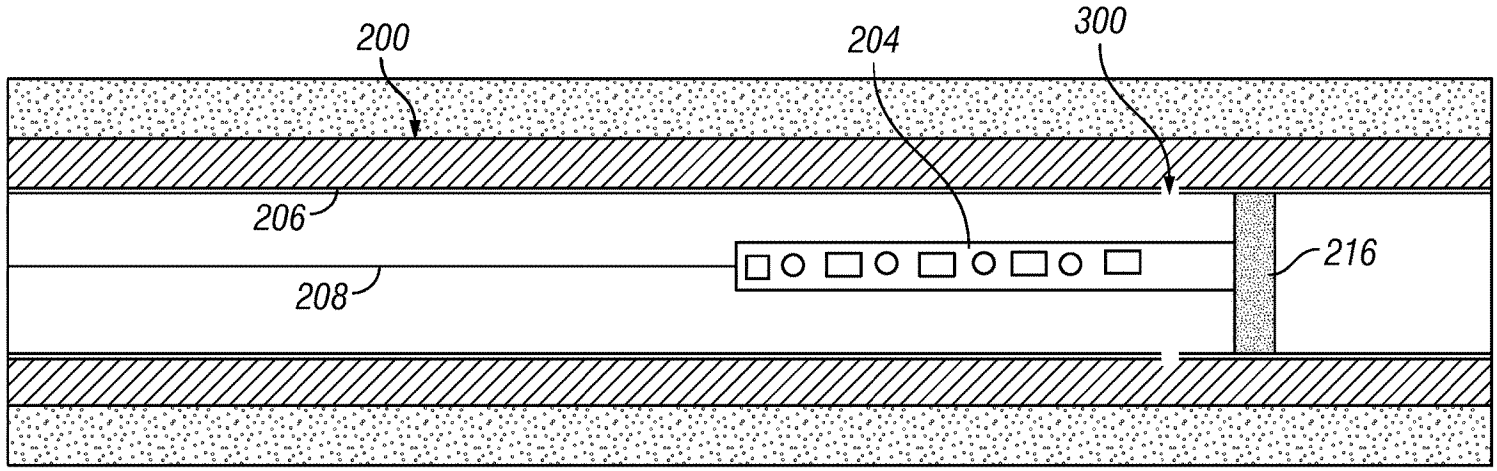
FIG. 3 is a cross-sectional diagram of the borehole of FIG. 2 after the first charge of the perforation tool has been detonated.

Once the perforation tool 202 has reached the target location within the borehole 200 and the plug 216 has been set, a control system 118 or an operator designates a charge or charge cluster 210 that will be detonated. A signal is then sent from the control system 118 shown in FIG. 1 downhole to the perforation 204 via the wireline 208 or similar mechanism. The signal directs the perforation tool 204 to detonate the designated charge or charge cluster 210, creating a perforation 300 in the casing 206, as shown in FIG. 3.

Figure 4:
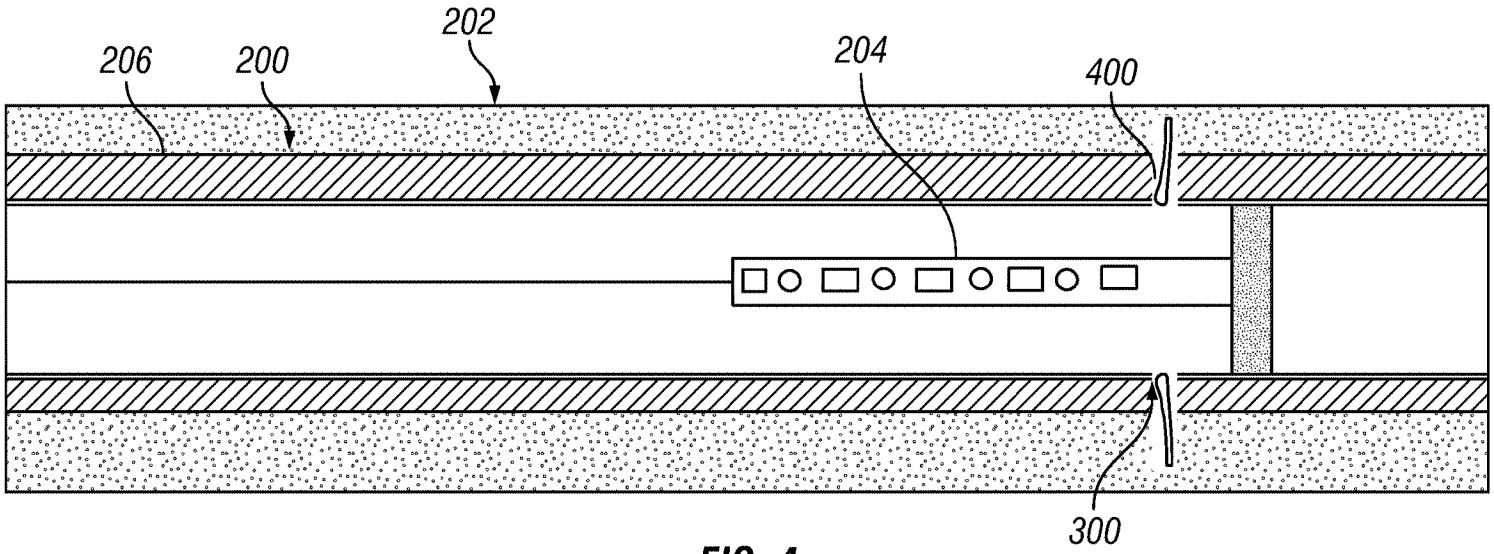
FIG. 4 is a cross-sectional diagram of the borehole of FIG. 3 during fracturing of the formation through perforations caused by the first charge.

After the casing has been perforated, fractures 400 are created in the formation, as shown in FIG. 4. To create the fractures 400 in the formation, fracturing fluid is pressurized and pumped downhole via a pump, such as the pump 114 shown in FIG. 1. The pressurized fluid travels through the perforations in the casing 206 to create fractures 400 in the formation 202 through which oil and gas can be produced.

Once the fractures 400 are created, a treatment fluid, such as stimulation fluid, is pumped into the formation at high pressure to expand the fractures 400 to a desired fracture geometry. Proppant may also be introduced into the fractures 400 via the treatment fluid to ensure the fractures 400 maintain the expanded fracture geometry after the treatment fluid is no longer being pumped into the formation.

Several methods may be used to determine when the treatment operations have been completed. For example, treatment may be considered complete when a set amount of treatment fluid has been pumped into the formation 202. Also, sensor measurements, such as those taken by a fiber optic sensor 120 as shown in FIG. 1, may be used to determine when the fracture has reached a desired fracture geometry. Specifically, a fiber optic sensor may measure the flowrate of the fluid entering the formation 202 through the fracture to determine the total amount of fluid that has entered the formation 202. Alternatively, the fiber optic sensor may detect microseismic events in the formation 202, and/or measure strain in the casing 206 to determine when the fractures 400 have reached the desired geometry.

In place of or in addition to a fiber optic sensor, geophones may be used to measure microseismic events in the formation 202 and microdeformation sensors may be used to measure deformation in the formation and/or borehole surrounding the fractures 400. Additionally, sensors, e.g., a fiber optic sensor, microdeformation sensors, and/or microseismic sensors, may be placed in adjacent wellbores to monitor various conditions in the formation 202 to determine when treatment operations are complete.

Figure 5:
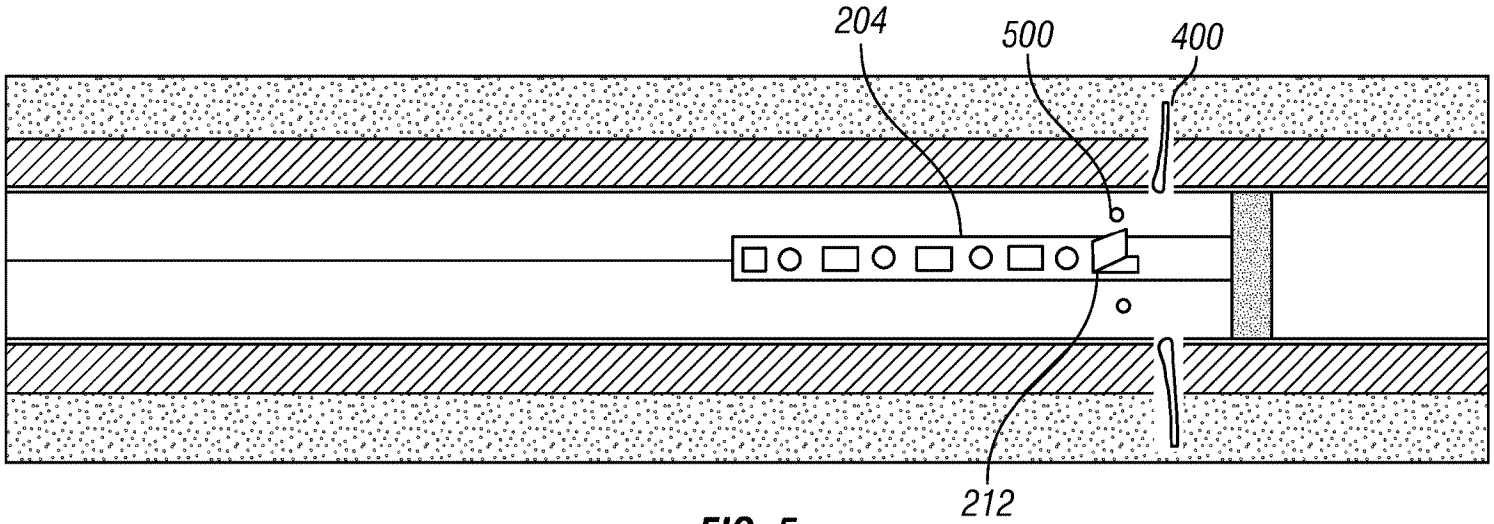
FIG. 5 is a cross-sectional diagram of the borehole of FIG. 4 after diverter material has been released from the perforation tool.
Figure 6:
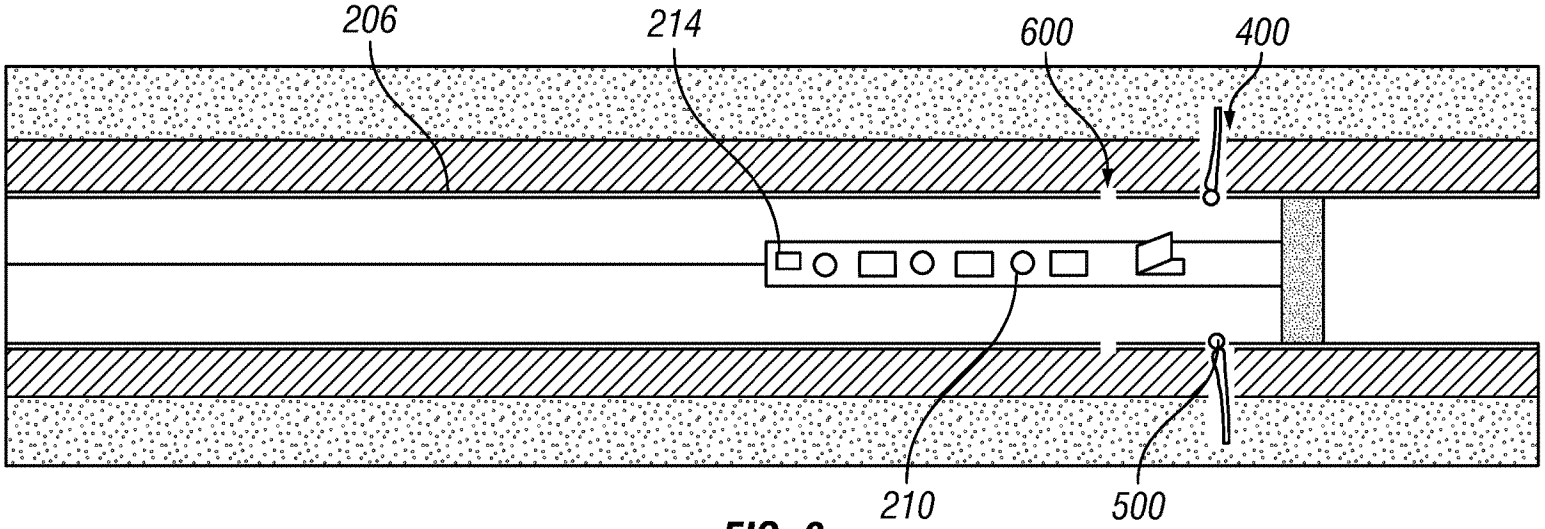
FIG. 6 is a cross-sectional diagram of the borehole of FIG. 5 after the second charge of the perforation tool has been detonated.

Once creation or treatment of the fractures 400 has been completed, diverter material 500 may be released from one or more of the compartments 212 of the perforation tool 204, as shown in FIG. 5. As previously discussed, the diverter material 500 may be mechanical diverter material or chemical diverter material, or any combination thereof. As shown in FIG. 6, the diverter material 500 is pumped into the fracture 400 to plug the fractures 400 and prevent additional fluid from entering the fractures 400 until the diverter material is removed through milling or dissolves over time.

To determine if the diverter material 500 has successfully plugged the fractures 400, the pressure within the borehole 200 is monitored using the pressure sensor 214 on the perforation tool 204. An increase in borehole pressure detected by the pressure sensor 214 can indicate that the diverter material 500 has plugged the fractures 400. In addition to or in place of the pressure sensor 214 on the perforation tool 204, a pump pressure sensor at the pump 114 or the fiber optic sensor 120 may be used to determine if the fractures 400 have been successfully plugged. If the fractures 400 have not been plugged successfully, another compartment 212 of the perforation tool 204 may be opened to release additional diverter material 500. Alternatively or in addition to opening an additional compartment 112, diverter material 500 may be pumped downhole from the surface. Once it is determined that the fractures 400 have been successfully plugged by the diverter material 500, a second charge or charge cluster 210 is detonated to create perforations 600 in the casing 206 at a second location without the need to move the perforation tool 204. In other embodiments, the plug 216 may be left in place and the perforation tool 204 may be withdrawn from the borehole during treatment of the fractures 400. The perforation tool 204 may then be pumped back downhole and repositioned on the plug 216 once treatment operations have concluded.

Figure 7:
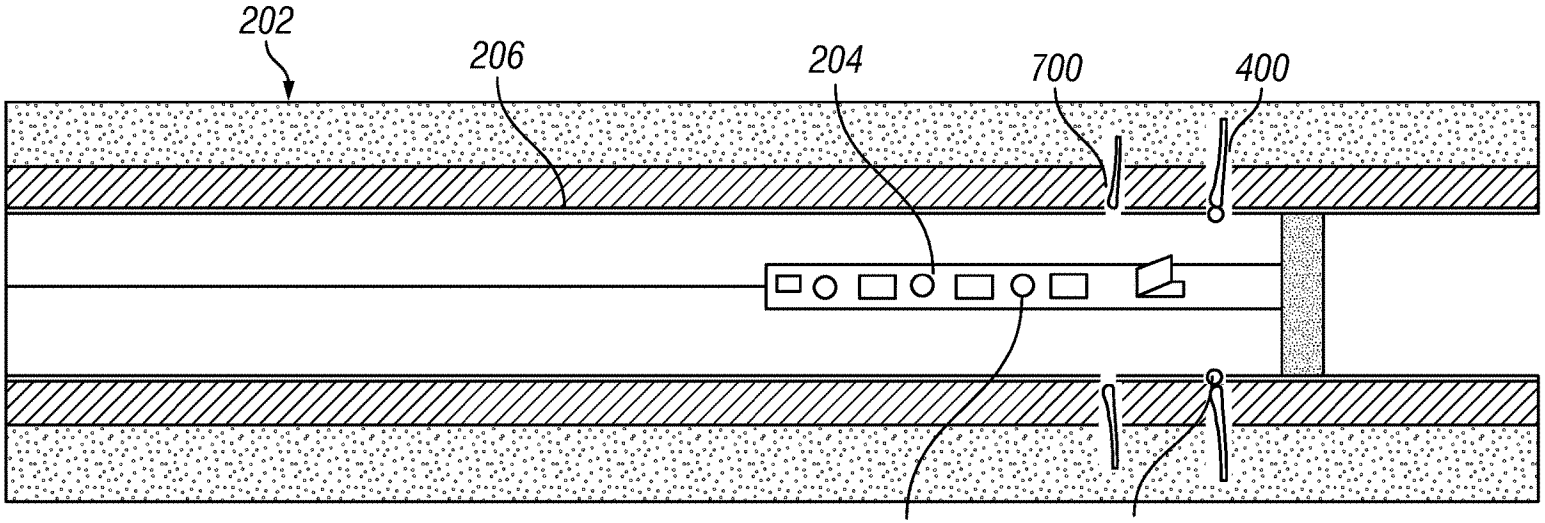
FIG. 7 is a cross-sectional diagram of the borehole of FIG. 6 during fracturing of the formation through perforations caused by the second charge.

As shown in FIG. 7, after the perforations 600 in the casing 206 have been created in the second location, fractures 700 are created in the formation 202 and then treated, as described above. The fluid used to create the fractures 700 in the formation 202 at the second location may be the same as the fluid used to create the fractures 400 in the formation 202 at the first location. Alternatively, a different fluid may be used. Similarly, the treatment fluid pumped into the fractures 700 at the second location may be the same fluid or a different fluid than the fluid that is used to treat the fractures 400 at the first location.

Figure 8:
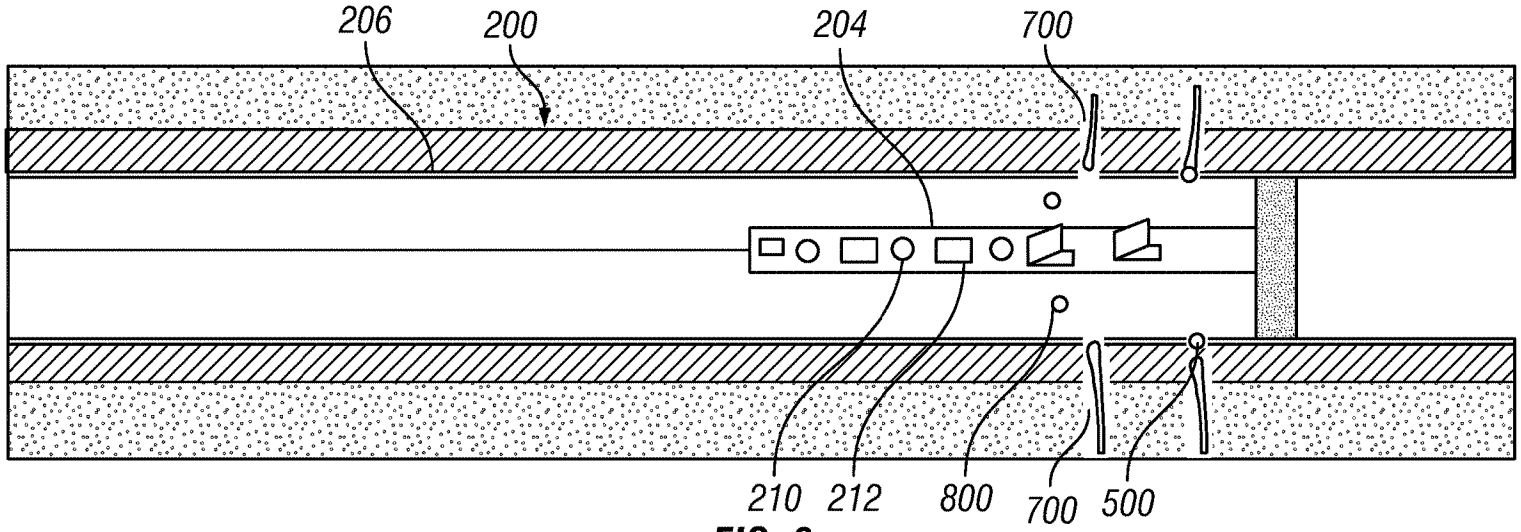
FIG. 8 is a cross-sectional diagram of the borehole of FIG. 7 after additional diverter material has been released from the perforation tool.
Figure 9:
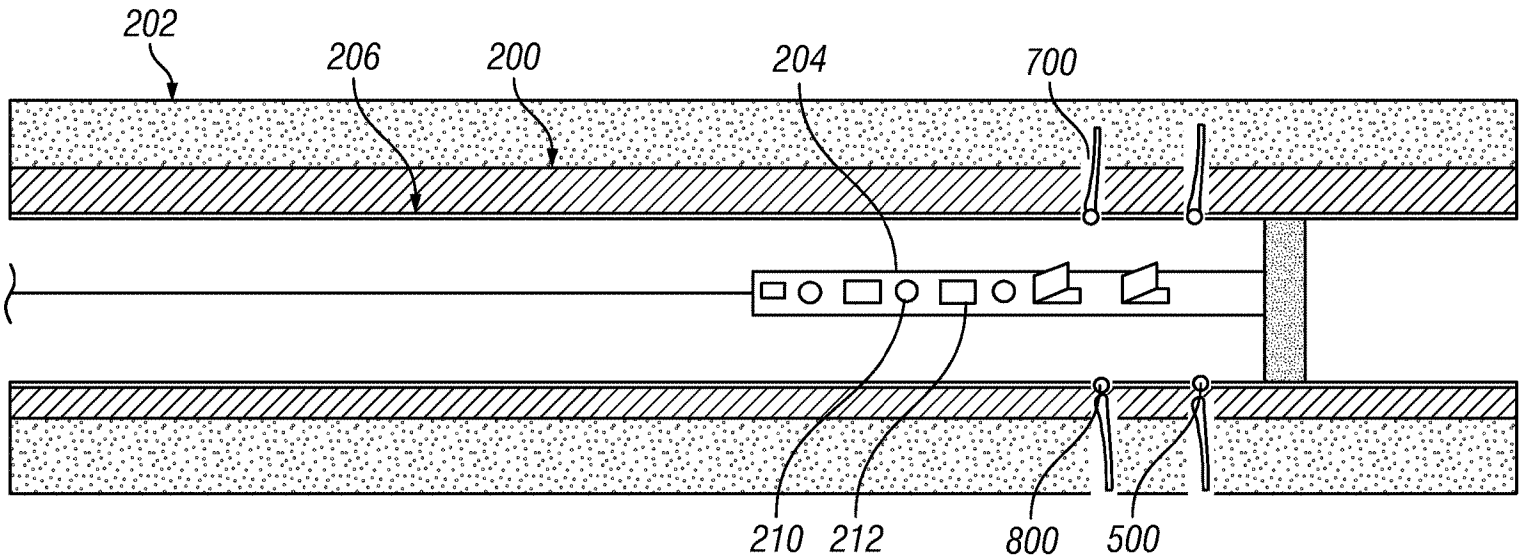
FIG. 9 is a cross-sectional diagram of the borehole of FIG. 8 after the fractures have been plugged.

Once the fractures 700 at the second location have reached the desired geometry through creation and treatment of the fractures 700, the control system 118 sends a signal to the perforation tool 204 to release additional diverter material 800 from one or more of the compartments 212, as shown in FIG. 8. The diverter material 800 is then pumped into the fractures 700 at the second location to plug the fractures 700, as shown in FIG. 9.

The process of perforating the casing 206, creating new fractures in the formation 202 at the locations surrounding the perforations, treating the fractures, releasing diverter material from the compartments 212 in the perforation tool 204, and plugging the fractures is repeated until all of the charges or charge clusters 210 in the perforation tool 204 have be used.

Occasionally, the diverter material contained in the perforation tool 204 may be exhausted before all of the charges or charge clusters 210 have been detonated. When this occurs, diverter material may be pumped downhole from the surface to plug fractures in the formation 202.

Additionally, multiple charges or charge clusters 210 may be detonated to perforate the casing 206 prior to performing any additional operations on the borehole 200. Fractures may then be created in the formation 202 and treated as a single unit instead of individually.

Figure 10:
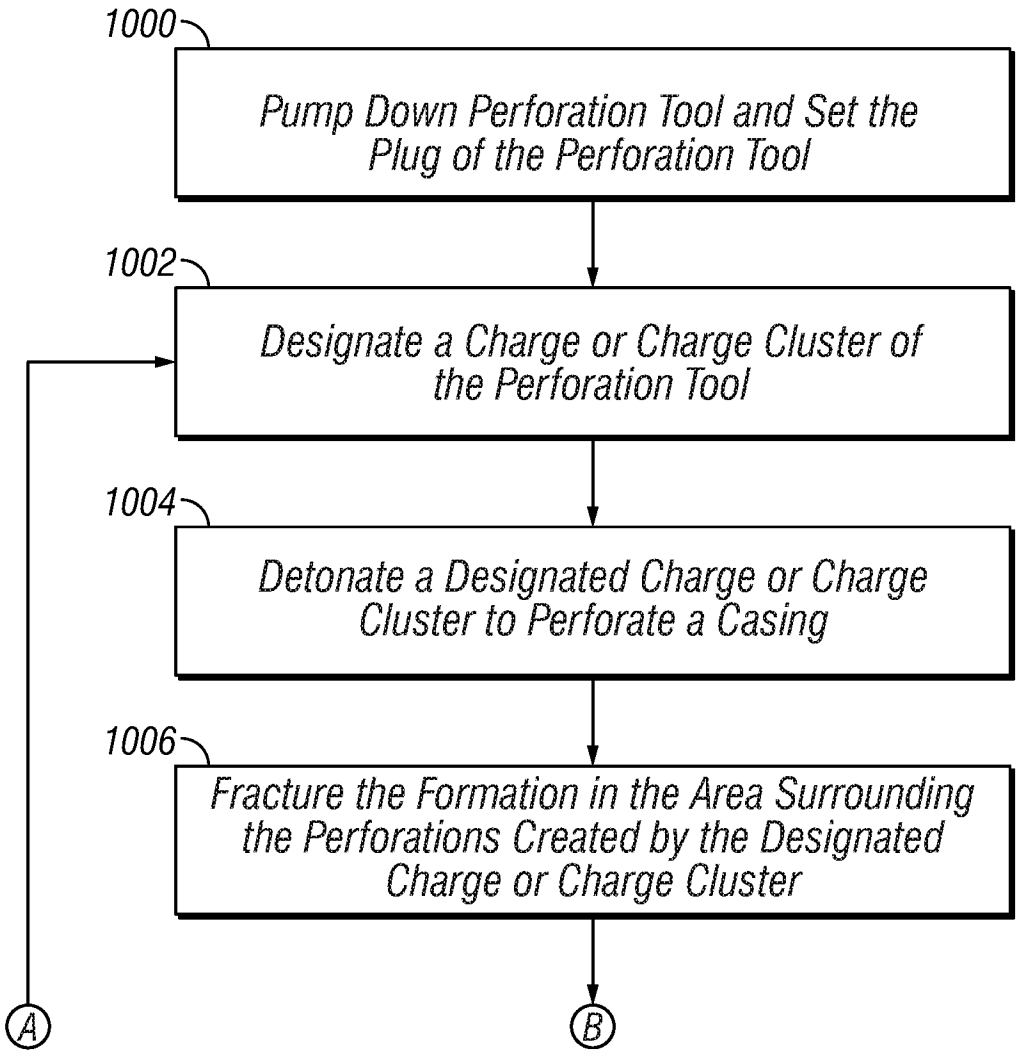
FIG. 10 is a flow chart illustrating a method of fracturing a formation.
Figure 10:
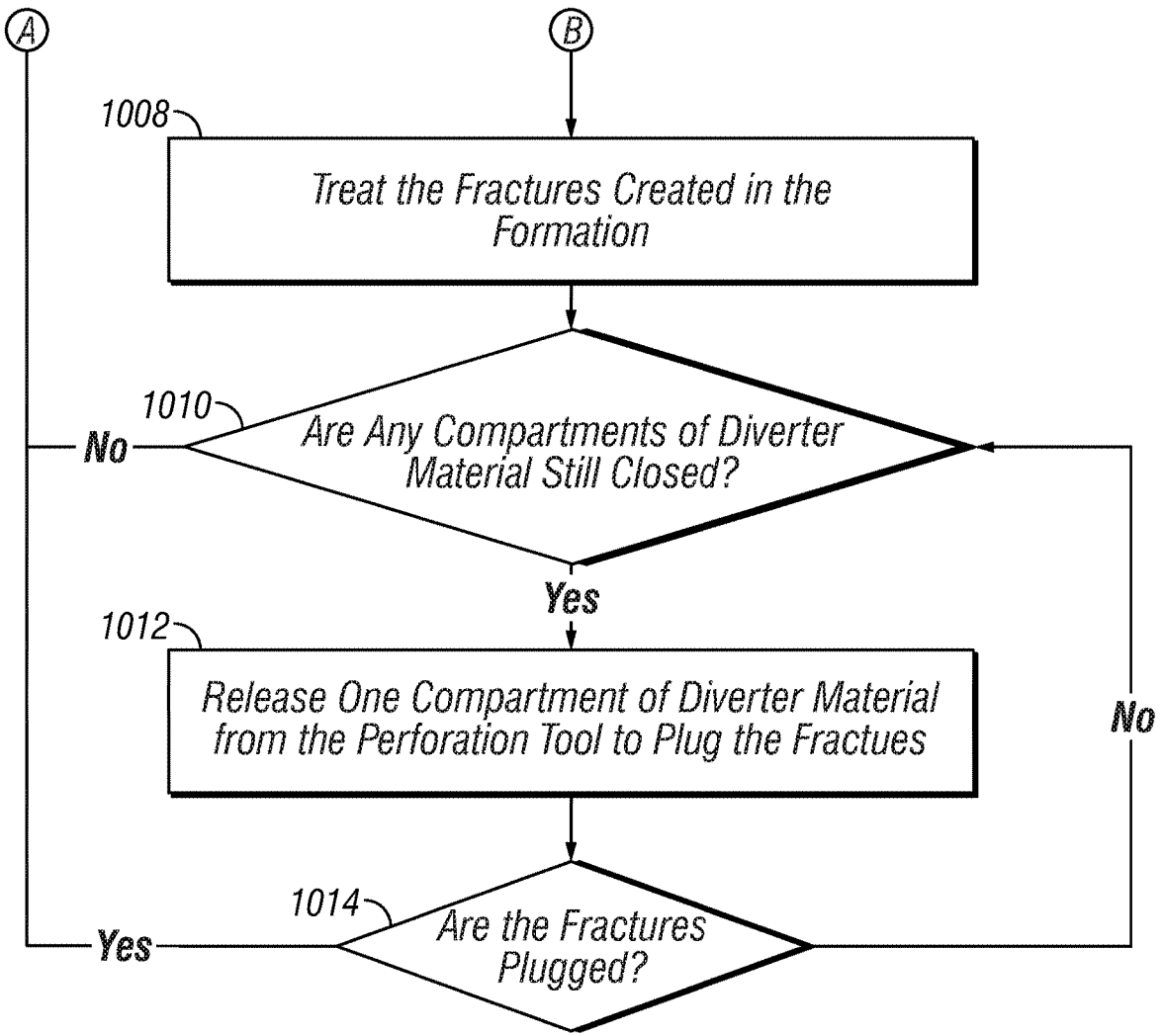

FIG. 10 is a flow chart illustrating a method of fracturing a formation. A perforation tool is pumped downhole and a plug of the perforation tool is set, as shown at 1000. A charge or charge cluster of the perforation tool is then designated by the operator or a control system, as shown at 1002. The designated charge or charge cluster is then detonated via signal from the control system to perforate a casing, as shown at 1004. As shown at 1006, fractures are then created in the area of the formation surrounding the perforations created by the charge or charge cluster, as described above. As shown at 1008, the fractures created in the formation are then treated, as described above.

Once the fractures have been treated, it is then determined if any compartments of diverter material are still closed, as shown at 1010. If there is not diverter material left in the perforation tool, a new charge or charge cluster is designated, as shown at 1002. However, if there is diverter material left in the perforation tool, one compartment of the diverter material is released from the perforation tool to plug the fractures, as shown at 1012. After the diverter material has been released from the perforation tool, it is then determined if the fractures are plugged, as shown at 1014. If the fractures are plugged, a new charge or charge cluster is designated, as shown at 1002.

If the fractures are not plugged, it is determined if there is diverter material left in the perforation tool, as shown at 1010. If there is not diverter material left in the perforation tool, a new charge or charge cluster is designated, as shown at 1002. However, if there is diverter material left in the perforation tool, the steps shown at 1012 and 1014 are repeated.

Further examples include:

Example 1 is a perforation tool for perforating casing in a borehole. The perforation tool includes a body, charges spaced along an axial length of the body, and a first compartment positioned along the axial length of the body. The compartment is filled with a diverter material and operable to selectively release the diverter material.

In Example 2, the embodiments of any preceding paragraph or combination thereof further include a pressure sensor positioned to measure borehole pressure.

In Example 3, the embodiments of any preceding paragraph or combination thereof further include a plug coupled to the body and configured to seal a portion of the borehole downhole of the body.

In Example 4, the embodiments of any preceding paragraph or combination thereof further include wherein the diverter material includes at least one of a mechanical diverter material, a chemical diverter material, or a combination of mechanical diverter material and chemical diverter material.

In Example 5, the embodiments of any preceding paragraph or combination thereof further include wherein the first compartment is positioned between two charges.

In Example 6, the embodiments of any preceding paragraph or combination thereof further include a second compartment filled with a diverter material.

Example 7 is fracturing system for fracturing a downhole formation in communication with the surface through a casing positioned within a borehole. The fracturing system includes a pump and a perforation tool. The perforation tool includes a body, charges spaced along an axial length of the body, and a first compartment positioned along the axial length of the body. The compartment is filled with a diverter material and operable to selectively release the diverter material.

In Example 8, the embodiments of any preceding paragraph or combination thereof further include wherein the perforation tool further includes a pressure sensor positioned to measure borehole pressure.

In Example 9, the embodiments of any preceding paragraph or combination thereof further include wherein the perforation tool further includes a plug coupled to the body and configured to seal a portion of a borehole that is downhole of the perforation tool.

In Example 10, the embodiments of any preceding paragraph or combination thereof further include wherein the diverter material includes at least one of mechanical diverter material or chemical diverter material.

In Example 11, the embodiments of any preceding paragraph or combination thereof further include wherein the first compartment is positioned between two charges.

In Example 12, the embodiments of any preceding paragraph or combination thereof further include wherein the pump includes a pressure sensor positioned to measure pressure of a fluid pumped into the borehole.

In Example 13, the embodiments of any preceding paragraph or combination thereof further include a fiber optic sensor disposed within the borehole.

In Example 14, the embodiments of any preceding paragraph or combination thereof further include wherein the perforation tool includes a second compartment filled with a diverter material.

Example 15 is a method of fracturing a formation through a casing within a borehole formed in the formation. The method includes positioning a perforation tool within the casing. The method also includes detonating a first charge of the perforation tool to create perforations through the casing at a first location. The method further includes pumping fracturing fluid through the perforations at the first location to create first fractures in the formation. The method also includes releasing diverter material from the perforation tool to plug the first fracture in the formation.

In Example 16, the embodiments of any preceding paragraph or combination thereof further include sealing the casing downhole of the perforation tool.

In Example 17, the embodiments of any preceding paragraph or combination thereof further include pumping treatment fluid into the first fractures to treat the first fracture prior to releasing the diverter material.

In Example 18, the embodiments of any preceding paragraph or combination thereof further include wherein treating the first fractures prior to releasing the diverter material includes measuring at least one of a strain along the casing, a pressure within the borehole, or a flowrate of the treatment fluid pumped into the fracture to determine when the treatment of the first fractures is complete.

In Example 19, the embodiments of any preceding paragraph or combination thereof further include detonating a second charge of the perforation tool to perforate the casing at a second location without moving the perforation tool. The embodiments of any preceding paragraph or combination thereof also include pumping fracturing fluid through the perforations in the casing at the second location to create second fractures in the formation.

In Example 20, the embodiments of any preceding paragraph or combination thereof further include releasing additional diverter material from the perforation tool to plug the second fractures in the formation.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A fracturing system for fracturing a downhole formation in communication with the surface through a casing positioned within a borehole, the fracturing system comprising;

a strain sensor operable to measure strain along the casing when the casing is positioned within the borehole;

a pump;

a perforation tool comprising:

a body;

charges spaced along an axial length of the body; and a first compartment positioned along the axial length of the body, the first compartment filled with a diverter material, the first compartment being operable to selectively release the diverter material a control system in electronic communication with the sensor and programmed to:

measure a strain along the borehole via the sensor; then determine when a treatment of the first fractures is complete based on the measurement; and then release the diverter material from the first compartment based on the determination.

2. The fracturing system of claim 1, wherein the perforation tool further comprises a pressure sensor positioned to measure borehole pressure.

3. The fracturing system of claim 1, wherein the perforation tool further comprises a plug coupled to the body and configured to seal a portion of a borehole that is downhole of the perforation tool.

4. The fracturing system of claim 1, wherein the diverter material comprises at least one of mechanical diverter material or chemical diverter material.

5. The fracturing system of claim 1, wherein the first compartment is positioned between two charges.

6. The fracturing system of claim 1, wherein the pump comprises a pressure sensor positioned to measure pressure of a fluid pumped into the borehole.

7. The fracturing system of claim 1, wherein the strain sensor comprises a fiber optic sensor disposable within the borehole.

8. The fracturing system of claim 1, wherein the perforation tool comprises a second compartment filled with a diverter material.

9. A method of fracturing a formation through a casing within a borehole formed in the formation, the method comprising:

positioning a perforation tool within the casing; then detonating a first charge of the perforation tool to create perforations through the casing at a first location;

pumping fracturing fluid through the perforations at the first location to create first fractures in the formation;

pumping treatment fluid into the first fractures to treat the first fractures; then measuring a strain along the casing to determine when the treatment of the first fracture is complete; and then releasing diverter material from the perforation tool to plug the first fractures in the formation.

10. The method of claim 9, further comprising sealing the casing downhole of the perforation tool.

11. The method of claim 9, further comprising:

detonating a second charge of the perforation tool to perforate the casing at a second location without moving the perforation tool; and pumping fracturing fluid through the perforations in the casing at the second location to create second fractures in the formation.

12. The method of claim 11, further comprising releasing additional diverter material from the perforation tool to plug the second fractures in the formation.

* * * * *